US007473072B2

(12) United States Patent
Malak et al.

(10) Patent No.: US 7,473,072 B2
(45) Date of Patent: Jan. 6, 2009

(54) TURBINE BLADE TIP AND SHROUD CLEARANCE CONTROL COATING SYSTEM

(75) Inventors: Malak F. Malak, Tempe, AZ (US); Derek Raybould, Denville, NJ (US); Thomas E. Strangman, Prescott, AZ (US)

(73) Assignee: Honeywell International Inc., Morristown, NJ (US)

( * ) Notice: Subject to any disclaimer, the term of this patent is extended or adjusted under 35 U.S.C. 154(b) by 504 days.

(21) Appl. No.: 11/218,074

(22) Filed: Aug. 31, 2005

(65) Prior Publication Data

US 2006/0171813 A1 Aug. 3, 2006

Related U.S. Application Data

(60) Provisional application No. 60/648,725, filed on Feb. 1, 2005.

(51) Int. Cl.
*F01D 5/20* (2006.01)

(52) U.S. Cl. ..... 415/173.4; 415/174.4

(58) Field of Classification Search ..... 415/9, 415/173.1, 173.4, 174.4, 200
See application file for complete search history.

(56) References Cited

U.S. PATENT DOCUMENTS 4,422,648 A * 12/1983 Eaton et al. ..... 277/415
4,669,955 A * 6/1987 Pellow ..... 415/173.4
4,704,332 A 11/1987 Brennan et al.
5,059,095 A 10/1991 Kushner et al.
5,474,421 A 12/1995 Rossmann
5,512,382 A * 4/1996 Strangman ..... 428/632
6,180,262 B1 1/2001 Freling et al.
6,190,124 B1 2/2001 Freling et al.
6,394,755 B1 5/2002 Stowell et al.
6,482,537 B1 11/2002 Strangman et al.
6,660,405 B2 12/2003 Lau et al.
2003/0054196 A1 3/2003 Lau et al.
2003/0138658 A1 7/2003 Taylor et al.
2004/0137259 A1 7/2004 Pabla et al.
2005/0079343 A1* 4/2005 Raybould et al. ..... 428/336

FOREIGN PATENT DOCUMENTS

EP 0443877 A1 8/1991

* cited by examiner

*Primary Examiner*—Edward Look
*Assistant Examiner*—Nathaniel Wiehe
(74) *Attorney, Agent, or Firm*—Ingrassia Fisher & Lorenz, P.C.

(57) ABSTRACT

A turbine blade tip and shroud clearance control coating system comprising a dense abrasive blade tip layer and an abradable shroud layer are provided. The dense abrasive coating may comprise cubic zirconia, hafnia or mixtures thereof and the abradable layer may be a nanolaminate thermal barrier coating that is softer than the dense abrasive layer.

21 Claims, 2 Drawing Sheets

TURBINE BLADE TIP AND SHROUD CLEARANCE CONTROL COATING SYSTEM

This application claims the benefit of U.S. Provisional Application No. 60/648,725 filed Feb. 1, 2005, the disclosure of which is incorporated by reference herein.

BACKGROUND OF THE INVENTION

The present invention relates generally to coating systems for turbine blades and shrouds for gas turbine engines and more particularly, to coating systems having an abrasive coating on the turbine blade tip and a complementary abradable coating on the inner surface of the turbine shroud.

Gas turbine engines typically include a variety of rotary seal systems to maintain differential working pressures that are critical to engine performance. One common type of seal system includes a rotating blade positioned in a rub relationship with the inner surface of a shroud. With the operation of a gas turbine engine, blade tip wear during rubs with the shroud along with blade tip oxidation can reduce blade tip height and increase the blade tip to shroud clearance. Reduced blade tip clearance increases turbine performance and performance retention during the service of the gas turbine engine, resulting in a decrease in the expense of operation and maintenance of the engine.

Several rotary seal systems to minimize the blade tip to shroud clearance have been described in the prior art. The prior art systems basically have blades with ceramic coated tips that have the ability to abrade the inner surface of the shroud. One system, disclosed in U.S. Pat. No. 5,059,095 has a blade with a ceramic blade tip layer where the layer consists of aluminum oxide and zirconia-based oxide. U.S. Pat. No. 6,190,124 discloses a similar system having a blade with an abrasive tip that is harder than an abradable inner shroud surface. The blade tip has a metal bond coat, an aluminum oxide layer disposed on the metal bond coat and a zirconium oxide abrasive coat disposed on the aluminum oxide layer where the zirconium oxide abrasive coat has a columnar structure. However, while these rotary seal systems are an improvement over a blade and shroud with no abrasive or abradable coatings, respectively, they focus on an abrading blade tip coat but not on a corresponding inner shroud surface compatible with the abrading blade tip coat that would minimize the rubbing friction during engine operation. Such friction may result in bending stresses that may crack or overload the blade to failure.

As can be seen, there is a need for a rotary seal system for gas turbine engines having a blade with an abrading tip coating and a shroud with an abradable inner surface that is compatible with the abrading coating of the blade tip such that the friction of rubbing between the blade tip and the inner surface of the shroud is minimal. Such a rotary seal system should also maintain a minimum clearance between the blade tip and the inner surface of the shroud.

SUMMARY OF THE INVENTION

In one aspect of the present invention there is provided a turbine blade tip and shroud clearance control coating system comprising a turbine blade, the turbine blade comprising a blade tip; a dense abrasive coating comprising cubic zirconia, cubic hafnia or mixtures thereof; a turbine shroud, the shroud comprising an inner surface, wherein the inner surface is in a rub relationship with the blade tip; and a nanolaminate thermal barrier coating on the inner surface of the turbine shroud, the thermal barrier coating comprising alternating layers of a first material with a second material, the first material comprising stabilized zirconia, hafnia or mixtures thereof, and the second material comprising at least one metal oxide.

In another aspect of the present invention there is provided a turbine blade tip and shroud clearance control coating system comprising a silicon nitride turbine blade, the turbine blade comprising a blade tip; an oxidation resistant bond coating on the blade tip; a dense layer comprising cubic zirconia, cubic hafnia or mixtures thereof, the dense layer being disposed on the oxidation resistant bond coating; a turbine shroud, the shroud comprising an inner surface, wherein the inner surface is in a rub relationship with the blade tip; and a nanolaminate thermal barrier coating on the inner surface of the turbine shroud, the thermal barrier coating comprising alternating layers of a first material with a second material, the first material comprising stabilized zirconia, hafnia or mixtures thereof, and the second material comprising at least one metal oxide.

In a further aspect of the present invention, there is provided a turbine blade tip and shroud clearance control coating system comprising a nickel-based superalloy turbine blade, the turbine blade comprising a blade tip; an oxidation resistant bond coating on the blade tip, wherein the oxidation resistant bond coating comprises Pt-aluminide, NiCoCrAlY or NiCrAlY; a dense layer comprising cubic zirconia, cubic hafnia or mixtures thereof, the dense layer being disposed on the oxidation resistant bond coating; a turbine shroud, the shroud comprising an inner surface, wherein the inner surface is in a rub relationship with the blade tip; and a nanolaminate thermal barrier coating on the inner surface of the turbine shroud, the thermal barrier coating comprising alternating layers of a first material with a second material, the first material comprising stabilized zirconia, hafnia or mixtures thereof, and the second material comprising at least one metal oxide.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides a turbine blade tip and shroud clearance control coating system which may comprise a dense abrasive coating on the blade tip and an abradable, nanolaminate thermal barrier coating on the inner surface of a shroud. The present invention may be used in gas turbine engines that require tight clearances between the blade tip and the inner surface of the shroud, particularly engines which operate in high heat environments and/or high wear applications.

The turbine blade tip and shroud clearance control coating system (referred to as the "coating system" herein) of the present invention may combine a blade tip having a dense abrasive coating with a turbine shroud having a nanolaminate thermal barrier coating on the inner surface of the shroud. The dense abrasive coating may comprise cubic zirconia, hafnia or mixtures thereof. The nanolaminate thermal barrier coating may have hundreds to thousands of layers having layer interfaces decorated with a softer shearable constituent material, allowing the coating on the inner surface of the shroud to be easily abraded by the blade tip during turbine engine operation. In contrast to the coating system of the present invention which may have cubic zirconia or hafnia as the abrasive material, a number of prior art systems have embedded cubic boron nitride as the abrasive material in the tip coating. Cubic boron nitride is readily oxidized at higher temperatures, thereby limiting its use in applications where a turbine engine operates at high temperatures, i.e., greater than 2500° F. Moreover, the prior art systems do not provide a specific, complementary abradable coating for the inner surface of the shroud, irrespective of the abrasive material on the blade tip. In contrast, the coating system of the present invention provides an abradable nanolaminate thermal barrier coating that complements the abrasive blade tip coating.

Figure 1:
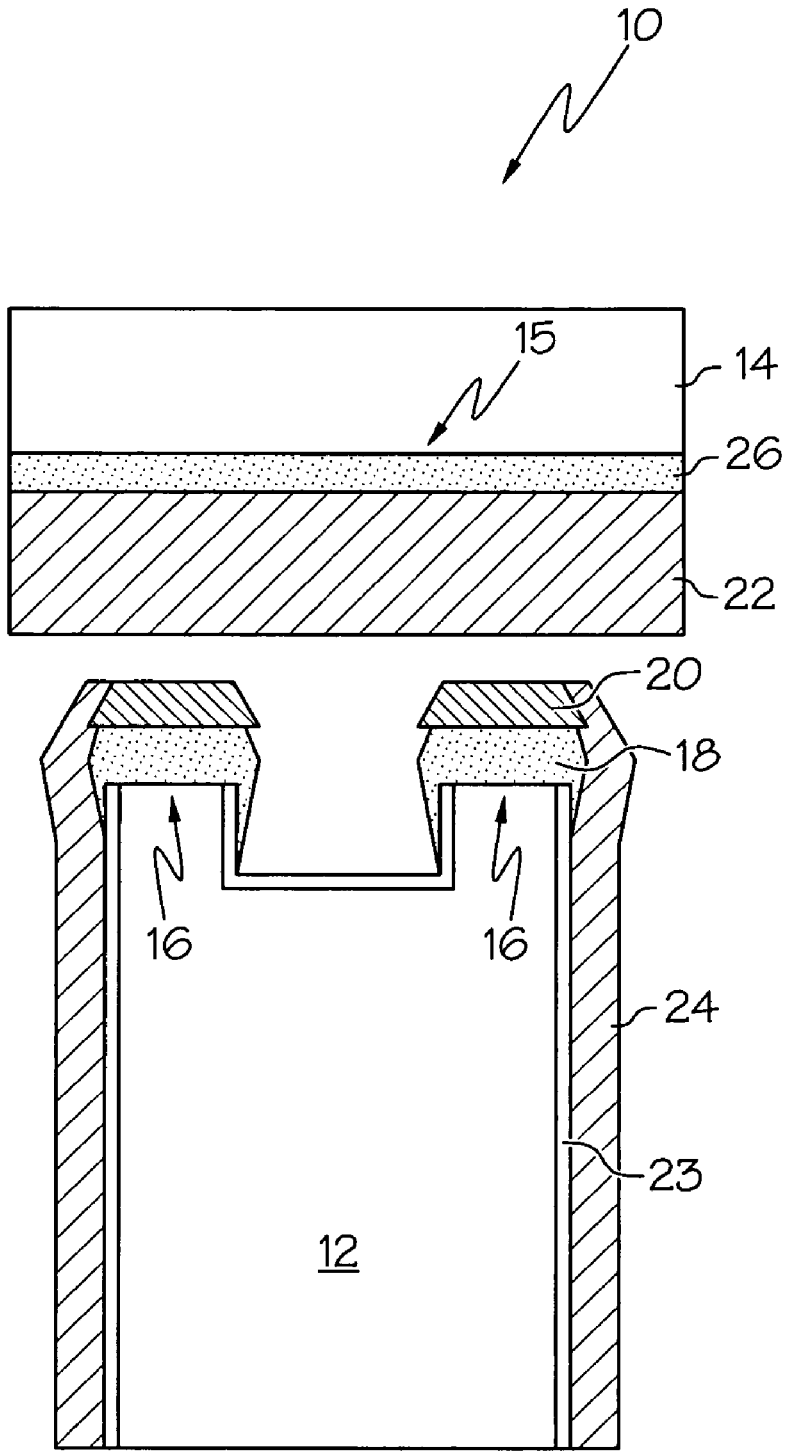
FIG. 1 shows a cross-section of a turbine blade and shroud of a gas turbine engine, according to the invention.

Referring to FIG. 1, there is shown a turbine blade tip and shroud clearance coating system 10 which may comprise a turbine blade 12 and a turbine shroud 14. Turbine blade 12 may comprise a turbine blade tip 16 and a dense abrasive coating 20 on turbine blade tip 16. Turbine blade tip 16 may further comprise an oxidation resistant bond coating 18, where oxidation resistant bond coating 18 may be disposed between blade tip 16 and dense abrasive coating 20. Turbine blade 12 may optionally further comprise an oxidation resistant coating 23 and a thermal barrier coating (TBC) 24 for added protection. Turbine shroud 14 may comprise an inner surface 15, where inner surface 15 may be in a rub relationship with turbine blade tip 16, and a nanolaminate thermal barrier coating (TBC) 22 applied to inner surface 15. Nanolaminate TBC 22 may comprise at least one abradable layer. Shroud 14 may further comprise an inner layer 26 disposed between shroud 14 and nanolaminate TBC 22, where the inner layer may be, but not limited to, an oxidation resistant bond coating, an environmental bond coating or another thermal barrier coating.

Turbine blade 12 may comprise any material known in the art for that purpose. An exemplary turbine blade 12 may comprise silicon nitride or a nickel-based superalloy. Oxidation resistant coating 18 may be any coating that protects the base material turbine blade 12 from oxidation during engine operation. Oxidation resistant coating 18 may also be compatible with the base material of the turbine blade so that it will strongly bond or adhere to turbine blade 12. In one illustrative embodiment, turbine blade 12 may comprise silicon nitride and oxidation resistant coating 18 may be a refractory metal silicide braze such as, but not limited to, $TaSi_2$+Si, or oxidation resistant coating 18 may be an alloyed tantalum oxide. In an alternate illustrative embodiment, turbine blade 12 may comprise a nickel-based superalloy and oxidation resistant coating 18 may comprise a Pt-aluminide coating, a NiCoCrAlY coating or a NiCrAlY coating.

Turbine blade 12 may further comprise dense abrasive coating 20 on turbine blade tip 16. Dense abrasive coating 20 may comprise cubic hafnia, cubic zirconia or mixtures thereof with a porosity of less than about 5 volume percent. Dense abrasive coating 20 may have a thickness of from about 50 μm to about 100 μm. Cubic zirconia or cubic hafnia may be hard enough to abrade nanolaminate TBC 22 of inner surface 15 of the inner shroud while being stable to oxidation at temperatures greater than 3,000° F. Therefore, unlike cubic boron nitride of the prior art, cubic zirconia or cubic hafnia may be used in long-life coating system 10 for high-temperature applications.

Dense abrasive coating 20 may be bonded to oxidation resistant coating 18. Oxidation resistant coating 18 may be chosen based on its resistance to water vapor and oxidation and its compatibility with both the blade tip 16 materials and the cubic zirconia and/or cubic hafnia dense abrasive coating 20. It will be appreciated that oxidation resistant coating 18 may be a type of environmental barrier coating and that other types of environmental barrier coatings may be used in the present invention.

Figure 2:
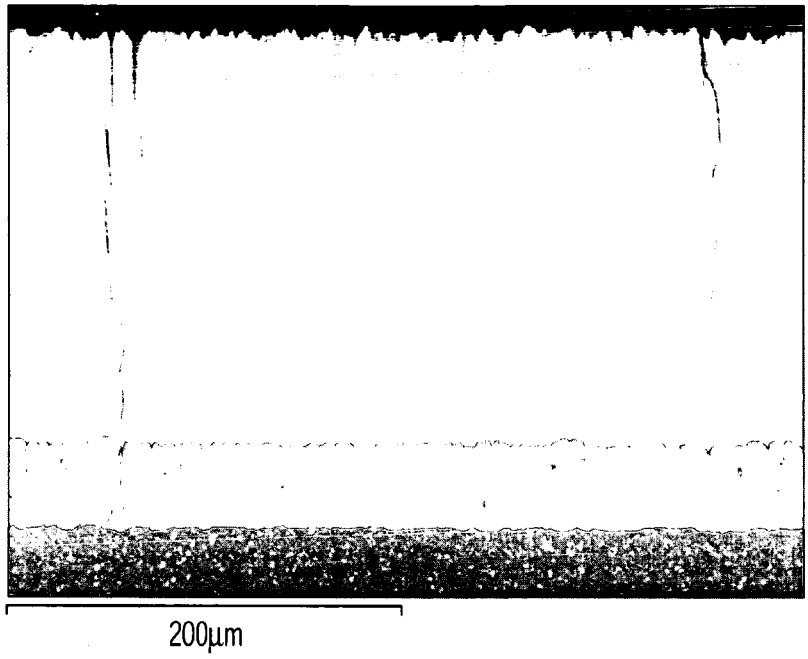
FIG. 2 is an electron micrograph of a cross-section of a dense abrasive blade tip coating, according to the invention.

In one embodiment, dense abrasive coating 20 may be applied to turbine blade tip 16 by electron beam evaporation-physical vapor deposition (EB-PVD). Dense abrasive coating 20 may be applied without rotating turbine blade tip 16 during application to produce a coating with less than 5 percent porosity. The dense microstructure of dense abrasive coating 20 applied by EB-PVD without rotating turbine blade tip 16 is shown in FIG. 2. Periodic cracking or segmentation may be observed within the abrasive layer and such periodic segmentation may provide compliance for accommodation of thermal expansion mismatch strains between abrasive coating 20 and turbine blade tip 16 and thermal strains during rubs with the shroud during engine operation. In one illustrative embodiment, dense abrasive coating 20 may have a thickness of from about 25 μm to about 250 μm. In another illustrative embodiment, dense abrasive coating 20 may have a thickness of from about 50 μm to about 100 μm. After application, dense abrasive coating 20 may be diamond ground to the exact thickness required for the particular turbine blade 12 and engine.

Turbine shroud 14 may comprise an inner surface 15 and a nanolaminate thermal barrier coating (TBC) 22 applied to inner surface 15. Turbine shroud 14 may further comprise an inner layer 26 disposed between inner surface 15 and nanolaminate TBC 22. Nanolaminate TBC 22 may be disposed directly on inner layer 26. Inner layer 26 may comprise an oxidation resistant bond coating or a second thermal barrier coating. Nanolaminate TBC 22 may be softer and more shearable than dense abrasive coating 20 so that nanolaminate TBC 22 may be abraded by turbine blade tip 16 having dense abrasive coating 20. Nanolaminate TBC 22 may comprise hundreds to thousands of deposition interfaces, or nanolayers, decorated with a softer shearable constituent material such as, but not limited to, tantalum oxide. In one illustrative embodiment, nanolaminate TBC 22 may comprise several hundred to a few thousand of alternating nanolayers of a first material with a second material, the first material comprising stabilized zirconia, hafnia or mixtures thereof, and the second material comprising at least one softer metal oxide. The metal oxide may be, but not limited to, tantalum oxide, alumina, niobium oxide or mixtures thereof. The stabilized zirconia and/or hafnia may be yittrium-stabilized zirconia and/or yittrium-stabilized hafnia. In one illustrative embodiment, nanolaminate TBC 22 may comprise from about 30 wt % to about 95 wt % stabilized zirconia, hafnia or mixtures thereof and from about 5 wt % to about 70 wt % of a metal oxide, where the metal oxide may be, but not limited to, tantalum oxide, alumina, niobium oxide or mixtures thereof. In one illustrative embodiment, nanolaminate TBC may be the nanolaminate TBC disclosed in commonly assigned U.S. Pat. No. 6,482,537 (the '537 patent), the disclosure of which is incorporated herein by reference. The nanolaminate TBC of the '537 patent was developed as a protective coating for preventing damage to turbine blades and shrouds at high operating temperatures. It has been found, however, that the nanolaminate TBC of the '537 patent may be an abradable coating for the turbine shroud 14 in conjunction with the dense abrasive coating 20 of the turbine blade tip 16.

Figure 3:
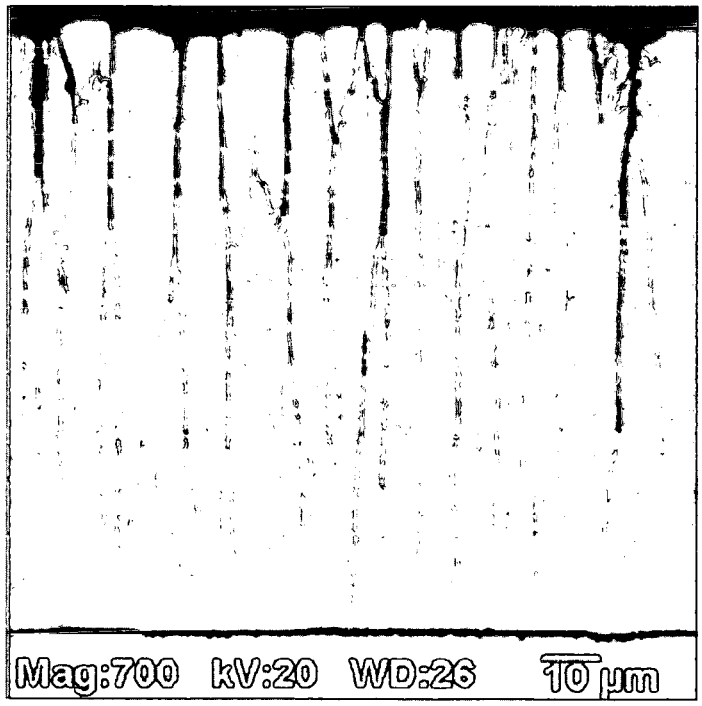
FIG. 3 is an electron micrograph of a cross-section of a nanolaminate thermal barrier coating, according to the invention.

Turbine shroud 14 may comprise either a superalloy or a ceramic material. Nanolaminate TBC 22 may be applied to inner surface 15 of turbine shroud 14 by EB-PVD. By way of non-limiting example, the EB-PVD process of the above referenced '537 patent may be used for applying nanolaminate TBC 22. The EB-PVD process may be conducted in a high-temperature environment. A high-energy electron beam may be focused and rastered across the end of an ingot comprising stabilized zirconia, hafnia or mixtures thereof, causing evaporation of the ingot. Rotating the inner surface 15 of turbine shroud 14 in the vapor from the ingot may produce a physical vapor deposition layer of stabilzed zirconia, hafnia or mixtures thereof. Nanolaminate TBC 22 may be further formed by incorporating a secondary ingot comprising a metal oxide that may enable decoration of the deposition interfaces of stabilized zirconia and/or hafnia with the metal oxide. Due to slow deposition rates and rotation of turbine shroud 14, the columnar grains that may be formed may have several hundred to about a few thousand deposition interfaces, or nanolayers. Adding from about several hundred to about a few thousand nanolayers may reduce thermal conductivity and make the grains of nanolaminate TBC 22 more shearable during a high-speed rub. The microstructure of a nanolaminate TBC 22 is illustrated in FIG. 3. Alternatively, nanolaminate TBC 22 may be applied by plasma spraying. Deposition by EB-PVD or plasma spraying is well known in the art. The number of layers in, and thickness of, nanolaminate TBC 22 may vary according to the dimensions of the engine and the blade tip clearance specifications for the engine. In one illustrative embodiment, nanolaminate TBC 22 may have a thickness of from about 50 μm to about 2000 μm. In another illustrative embodiment, each individual nanolayer in nanolaminate TBC 22 may have a thickness of from about 50 nm to about 500 nm. The thickness of the nanolayers may be equivalent. Alternatively, the thickness of the nanolayers may be varied. By way of non-limiting example, during deposition, the "soft" metal oxide layer may be made thicker from every about 10 nanolayers to about 100 nanolayers in order to promote shearing of the nanolaminate TBC 22, while maintaining the desirable low thermal conductivity. While not wishing to be bound by theory, it may be that the ideal nanolaminate microstructure for reduced thermal conductivity is probably different from that desired to promote shearing of the layers. During EB-PVD deposition it is easy to control the microstructure so that periodically a thicker more easily sheared layer may be deposited.

It should be understood, of course, that the foregoing relates to exemplary embodiments of the invention and that modifications may be made without departing from the spirit and scope of the invention as set forth in the following claims.

We claim:

1. A turbine blade tip and shroud clearance control coating system comprising:

a turbine blade, the turbine blade comprising a blade tip;

a dense abrasive coating disposed on the blade tip, the dense abrasive coating comprising cubic zirconia, cubic hafnia or mixtures thereof;

a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating nanolayers of a first material with a second material, the first material comprising stabilized zirconia, hafnia or mixtures thereof, and the second material comprising at least one metal oxide, wherein a thickness of the nanolayers is varied.

2. The system of claim 1 further comprising an oxidation resistant bond coating disposed between the blade tip and the dense abrasive coating.

3. The system of claim 2 wherein the turbine blade is a silicon nitride turbine blade and wherein the oxidation resistant bond coating comprises a refractory metal silicide braze or alloyed tantalum oxide.

4. The system of claim 3 wherein the refractory metal silicide braze is $TaSi_2$+Si.

5. The system of claim 2 wherein the dense abrasive coating is deposited on the oxidation resistant bond coating by electron beam evaporation-physical vapor deposition.

6. The system of claim 2 wherein the turbine blade is a nickel based superalloy turbine blade and the oxidation resistant bond coating comprises Pt-aluminide, NiCoCrAlY or NiCrAlY.

7. The system of claim 1 wherein the dense abrasive coating has a thickness of from about 25 μm to about 250 μm.

8. The system of claim 7 wherein the dense abrasive coating has a thickness of from about 50 μm to about 100 μm.

9. The system of claim 1 wherein nanolaminate thermal barrier coating comprises from about 5 wt % to about 70 wt % of the metal oxide and from about 30 wt % to about 95 wt % of stabilized zirconia, hafnia or mixtures thereof.

10. The system of claim 1 wherein the metal oxide of the nanolaminate thermal barrier coating is tantalum oxide, alumina or niobium oxide.

11. The system of claim 1 wherein the thickness of the metal oxide nanolayers is increased from every about 10 nanolayers to about 100 nanolayers.

12. The system of claim 1 wherein the nanolaminate thermal barrier coating is applied to the inner surface of the shroud by electron beam evaporation-physical vapor deposition or plasma spraying.

13. The system of claim 1 wherein the dense abrasive coating disposed on the blade tip is segmented.

14. The system of claim 1 wherein the nanolaminate thermal barrier coating has a thickness of from about 50 μm to about 2000 μm.

15. The system of claim 1 wherein the nanolaminate thermal barrier coating has a melting temperature of at least about 3000° F.

16. The system of claim 1 further comprising an inner layer wherein the nanolaminate thermal barrier coating is disposed directly on the inner layer.

17. The system of claim 16 wherein the inner layer is a bond coating, an environmental barrier coating or a second thermal barrier coating, wherein the second thermal barrier coating is different from the nanolaminate thermal barrier coating.

18. The system of claim 1, wherein the system is part of a gas turbine engine.

19. A turbine blade tip and shroud clearance control coating system comprising:

a nickel-based superalloy turbine blade, the turbine blade comprising a blade tip;

an oxidation resistant bond coating disposed on the blade tip, wherein the oxidation resistant bond coating comprises Pt-aluminide, NiCoCrAlY or NiCrAlY;

a dense abrasive coating comprising cubic zirconia, cubic hafnia or mixtures thereof, the dense abrasive coating being disposed on the oxidation resistant bond coating;

a turbine shroud, the shroud comprising an inner surface, wherein the inner surface is in a rub relationship with the blade tip; and a nanolaminate thermal barrier coating on the inner surface of the turbine shroud, the nanolaminate thermal barrier coating comprising alternating nanolayers of a first material with a second material, the first material comprising stabilized zirconia, hafnia or mixtures thereof, the second material comprising at least one metal oxide, and the nanolaminate thermal barrier coating comprises from about 5 wt % to about 70 wt % of the metal oxide and from about 30 wt % to about 95 wt % of stabilized zirconia, hafnia or mixtures thereof.

20. The system of claim 19 wherein the dense abrasive coating has a thickness of from about 25 μm to about 250 μm.

21. The system of claim 19 wherein the nanolaminate thermal barrier coating has a thickness of from about 50 μm to about 2000 μm.

* * * * *